US010646749B1

(12) United States Patent
Williams

(10) Patent No.: US 10,646,749 B1
(45) Date of Patent: May 12, 2020

(54) RESISTANCE EXERCISE GLOVE

(71) Applicant: Phillip Williams, Matteson, IL (US)

(72) Inventor: Phillip Williams, Matteson, IL (US)

( * ) Notice: Subject to any disclaimer, the term of this patent is extended or adjusted under 35 U.S.C. 154(b) by 98 days.

(21) Appl. No.: 15/985,933

(22) Filed: May 22, 2018

(51) Int. Cl.
*A63B 23/16* (2006.01)
*A63B 21/00* (2006.01)
(Continued)

(52) U.S. Cl.
CPC ..... *A63B 23/16* (2013.01); *A63B 21/0442* (2013.01); *A63B 21/0557* (2013.01);
(Continued)

(58) Field of Classification Search
CPC ..... A41D 19/01582; A63B 21/0004; A63B 21/00043; A63B 21/00058; A63B 21/00069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/15; A63B 21/151; A63B 21/159; A63B 21/4017; A63B 21/4019; A63B 21/4021; A63B 21/4023; A63B 21/4025; A63B 21/4027; A63B 21/4033; A63B 21/4035; A63B 21/4039; A63B 21/4041; A63B 21/4043; A63B 21/4045; A63B 21/4047; A63B 23/14; A63B 23/16; A63B 69/0057; A63B 69/0059; A63B 71/0054; A63B 71/14; A63B 71/141; A63B 71/143; A63B 71/145; A63B 71/146; A63B 71/148; A63B 2071/0063; A63B 2071/0072; A63B 2209/00; A63B 2209/02; A63B 2209/023
See application file for complete search history.

(56) References Cited

U.S. PATENT DOCUMENTS 3,347,547 A * 10/1967 Hynes ..... A63B 23/16 482/47
3,944,220 A 3/1976 Fasano
(Continued)

FOREIGN PATENT DOCUMENTS

GB 2237726 5/1991

*Primary Examiner* — Gary D Urbiel Goldner

(57) ABSTRACT

The resistance exercise glove is a therapeutic device and a garment worn on a hand. The resistance exercise glove exercises the hand by providing an opposing force that works against the movement of the hand. The opposing force provides a resistance based therapeutic exercise that strengthens the hand. The resistance exercise glove comprises a glove, a plurality of resistance bands, a pocket, and a squeeze device. The glove is further defined with a front side, a rear side, and an opening. The hand inserts into the glove through the opening. The plurality of resistance bands attach to the rear side of the glove such that each of the resistance bands opposes the bending of a finger. The pocket is formed on the front side of the glove. The pocket contains the squeeze device. The squeeze device is an elastomeric device that opposes the squeezing motion of the hand.

11 Claims, 4 Drawing Sheets

(51) Int. Cl.
*A63B 21/04* (2006.01)
*A63B 21/055* (2006.01)
*A41D 19/015* (2006.01)

(52) U.S. Cl.
CPC ..... *A63B 21/4019* (2015.10); *A63B 21/4025* (2015.10); *A41D 19/01582* (2013.01)

(56) References Cited

U.S. PATENT DOCUMENTS 4,796,306 A * 1/1989 Mitchell ..... A63B 71/148 2/161.5
4,830,360 A 5/1989 Carr, Jr.
5,365,609 A * 11/1994 Herzog ..... A63B 71/146 2/161.4
5,373,585 A * 12/1994 Wiggins ..... A41D 19/00 2/159
5,538,488 A 7/1996 Villepigue
5,697,103 A 12/1997 Wiggins
D445,995 S 8/2001 Stanley
7,234,172 B1 * 6/2007 Hoelscher ..... A41D 19/01582 2/161.1
7,406,720 B2 * 8/2008 Hoelscher ..... A41D 19/01588 2/161.1
7,731,633 B1 * 6/2010 Williams ..... A63B 21/0552 482/148
7,856,670 B1 * 12/2010 Hazuga ..... A63B 21/065 2/160
8,312,567 B1 * 11/2012 Valle ..... A63B 21/065 2/161.1
8,491,447 B1 7/2013 Koranic
8,601,614 B2 12/2013 Scaff
9,387,110 B2 7/2016 Kelly
2003/0051285 A1 * 3/2003 Bower ..... A63B 71/141 2/16
2003/0054923 A1 * 3/2003 Brassil ..... A63B 23/16 482/49
2004/0103465 A1 * 6/2004 Kleinert ..... A41D 19/015 2/16
2005/0054487 A1 * 3/2005 Rogers ..... A63B 21/026 482/44
2006/0026738 A1 * 2/2006 Kleinert ..... A41D 19/015 2/163
2007/0061943 A1 * 3/2007 Kleinert ..... A63B 71/143 2/159
2008/0072358 A1 * 3/2008 Kleinert ..... A41D 19/015 2/21
2011/0314582 A1 * 12/2011 Kleinert ..... A41D 19/015 2/20
2012/0065026 A1 * 3/2012 Land ..... A63B 21/00065 482/47
2014/0287882 A1 * 9/2014 Barner ..... A63B 23/16 482/47
2015/0141206 A1 * 5/2015 James, Jr. ..... A63B 23/16 482/47
2015/0328492 A1 * 11/2015 Marriott ..... A63B 21/0421 482/124
2016/0332817 A1 * 11/2016 Ahdoot ..... A41D 19/01582
2017/0028244 A1 * 2/2017 Schreiber ..... A63B 21/0557
2017/0181487 A1 * 6/2017 Kleinert ..... A41D 19/01576
2017/0246071 A1 * 8/2017 Schultz ..... A41D 13/1236
2017/0361146 A1 * 12/2017 Malcolm ..... A63B 69/0028
2018/0133582 A1 * 5/2018 Sharp ..... A41F 1/06

* cited by examiner

RESISTANCE EXERCISE GLOVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of health and amusement including apparatus for physical training, more specifically, an exercise arrangement for hands and fingers.

The anatomy of the human hand 200 is best understood by understanding the bones within the hand 200. The wrist 260 comprises eight carpal bones that attach the fingers to the radius bone 261 and ulna bone 262 of the arm. Each finger is attached to the wrist 260 with a metacarpal bone. The thumb attaches to the wrist 260 with the proximal end of the first metacarpal 201 bone. The index finger attaches to the wrist 260 with the proximal end of the second metacarpal 202 bone. The middle finger attaches to the wrist 260 with the proximal end of the third metacarpal 203 bone. The ring finger attaches to the wrist 260 with the proximal end of the fourth metacarpal 204 bone. The little finger attaches to the wrist 260 with the proximal end of the fifth metacarpal 205 bone.

The thumb (First Finger 251) further comprises a first proximal phalange 211 and a first distal phalange 231. The bone structure of the thumb is completed by attaching the proximal end of the first proximal phalange 211 to the distal end of the first metacarpal 201 and attaching the proximal end of the first distal phalange 231 to the distal end of the first proximal phalange 211.

The index finger (Second Finger 252) further comprises a second proximal phalange 212, a second intermediate phalange 222, and a second distal phalange 232. The bone structure of the thumb is completed by attaching: 1) the proximal end of the second proximal phalange 212 to the distal end of the second metacarpal 202; 2) the proximal end of the second intermediate phalange 222 to the distal end of the second proximal phalange 212; and, 3) the proximal end of the second distal phalange 232 to the distal end of the second intermediate phalange 222.

The middle finger (Third Finger 253) further comprises a third proximal phalange 213, a third intermediate phalange 223, and a third distal phalange 233. The bone structure of the thumb is completed by attaching: 1) the proximal end of the third proximal phalange 213 to the distal end of the third metacarpal 203; 2) the proximal end of the third intermediate phalange 223 to the distal end of the third proximal phalange 213; and, 3) the proximal end of the third distal phalange 233 to the distal end of the third intermediate phalange 223.

The ring finger (Fourth Finger 254) further comprises a fourth proximal phalange 214, a fourth intermediate phalange 224, and a fourth distal phalange 234. The bone structure of the thumb is completed by attaching: 1) the proximal end of the fourth proximal phalange 214 to the distal end of the fourth metacarpal 204; 2) the proximal end of the fourth intermediate phalange 224 to the distal end of the fourth proximal phalange 214; and, 3) the proximal end of the fourth distal phalange 234 to the distal end of the fourth intermediate phalange 224.

The little finger (Fifth Finger 255) further comprises a fifth proximal phalange 215, a fifth intermediate phalange 225, and a fifth distal phalange 235. The bone structure of the thumb is completed by attaching: 1) the proximal end of the fifth proximal phalange 215 to the distal end of the fifth metacarpal 205; 2) the proximal end of the fifth intermediate phalange 225 to the distal end of the fifth proximal phalange 215; and, 3) the proximal end of the fifth distal phalange 235 to the distal end of the fifth intermediate phalange 225.

The first metacarpal 201 through the fifth metacarpal 205 are enclosed by what is referred to as the palm of the hand 200.

The human hand 200 is a grasping structure. The human hand 200 of the left side of the body is a mirror image of the human hand 200 of the right side of the body. The orientation is used to define the front side 151 of the hand 200. Specifically, the left hand 200 and the right hand 200 can only be overlaid on top of each other when the front side 151 of the left hand 200 is touching the front side 151 of the right hand 200. The side of the hand 200 opposite to the front side 151 is referred to as the rear side 152. The human hand 200 is further defined with a thumb (first finger 251), index finger (second finger 252), middle finger (third finger 253), ring finger (fourth finger 254), and a little finger (fifth finger 255).

Within this disclosure, when referring to the bones of a hand 200, this disclosure will refer to the end of the bone that is closest to the wrist 260 as the proximal end and the end of the bone that is furthest from the wrist 260 as the distal end. This is consistent with medical terminology. Further, this disclosure will identify specific locations on the hand 200 by referring to the bone of the hand 200 that is proximal to the location.

A glove is an item of apparel that covers a hand 200. The glove comprises five finger stalls into which the fingers of the hand 200 are inserted. Each finger stall is attached to a trank 116. The trank 116 is the portion of the glove that covers the palm of the hand 200. The front side 151 of the trank 116 is proximal to the front side 151 of the hand 200. The rear side 152 of the trank 116 is proximal to the rear side 152 of the hand 200. Typically: 1) the thumb from the first proximal phalange 211 to the first distal phalange 231 is inserted into the first finger stall 111; 2) the index finger from the second proximal phalange 212 to the second distal phalange 232 is inserted into the second finger stall 112; 3) the middle finger from the third proximal phalange 213 to the third distal phalange 233 is inserted into the third finger stall 113; 4) the ring finger from the fourth proximal phalange 214 to the fourth distal phalange 234 is inserted into the fourth finger stall 114; and, 5) the little finger from the fifth proximal phalange 215 to the fifth distal phalange 235 is inserted into the fifth finger stall 115. This disclosure will identify specific locations on a glove by referring to the bone of the hand 200 that is proximal to the location.

SUMMARY OF INVENTION

The resistance exercise glove is configured for use with a patient. The patient is further defined with a hand. The resistance exercise glove is a garment worn on the hand. The resistance exercise glove is a therapeutic device. The resistance exercise glove exercises the hand by providing an opposing force that works against the movement of the hand. The opposing force provides a resistance based therapeutic exercise that strengthens the hand. The resistance exercise glove comprises a glove, a plurality of resistance bands, a pocket, and a squeeze device. The glove is further defined with a front side, a rear side, and an opening. The hand inserts into the glove through the opening. The plurality of resistance bands attach to the rear side of the glove such that each of the resistance bands opposes the bending of a finger selected from the group consisting of the first finger, the second finger, the third finger, the fourth finger, and the fifth finger. The pocket is formed on the front side of the glove. The pocket contains a squeeze device. The squeeze device is an elastomeric device that opposes the squeezing motion of the hand.

These together with additional objects, features and advantages of the resistance exercise glove will be readily apparent to those of ordinary skill in the art upon reading the following detailed description of the presently preferred, but nonetheless illustrative, embodiments when taken in conjunction with the accompanying drawings.

In this respect, before explaining the current embodiments of the resistance exercise glove in detail, it is to be understood that the resistance exercise glove is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the resistance exercise glove.

It is therefore important that the claims be regarded as including such equivalent construction insofar as they do not depart from the spirit and scope of the resistance exercise glove. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
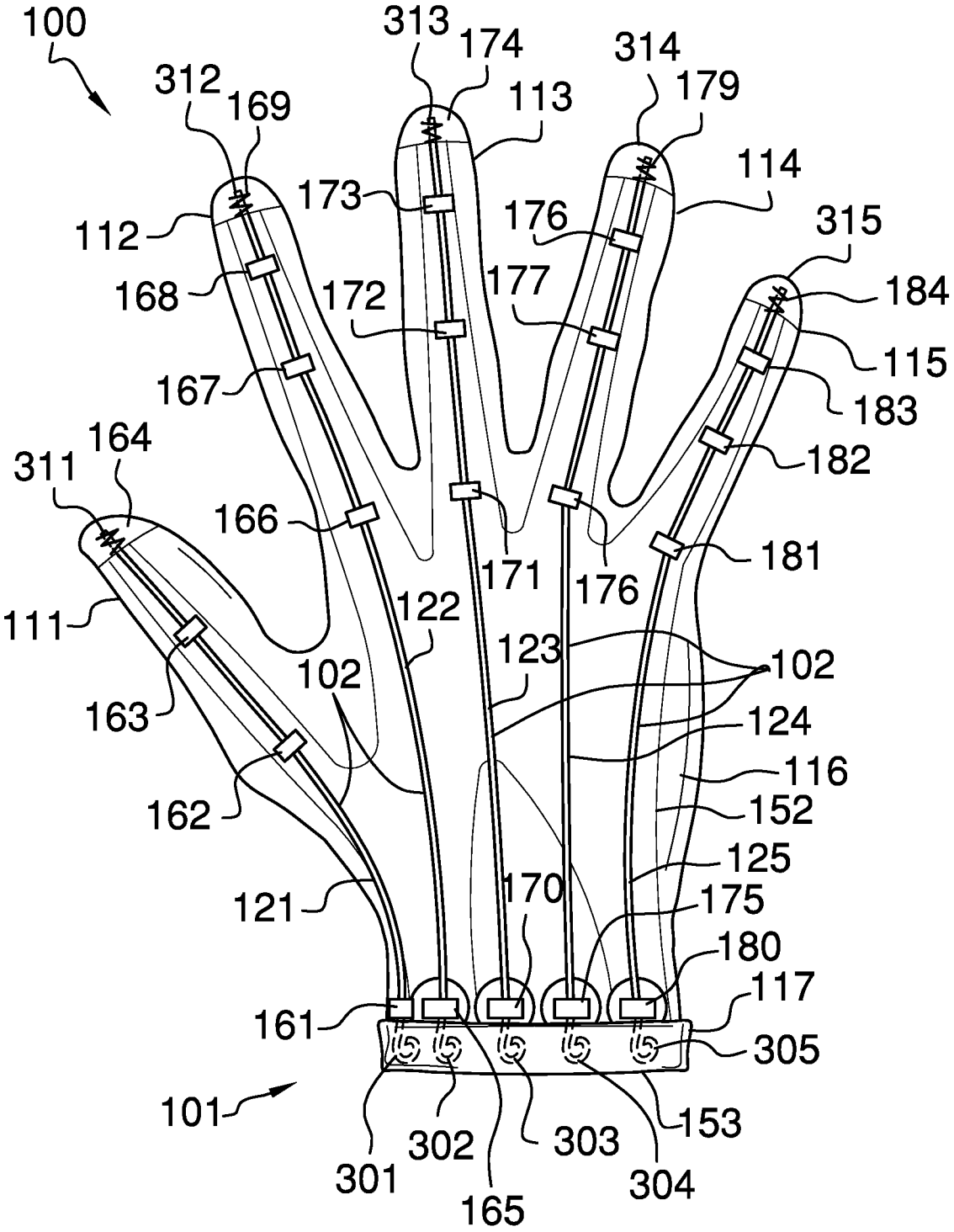
FIG. 1 is a rear side view of an embodiment of the disclosure.
Figure 2:
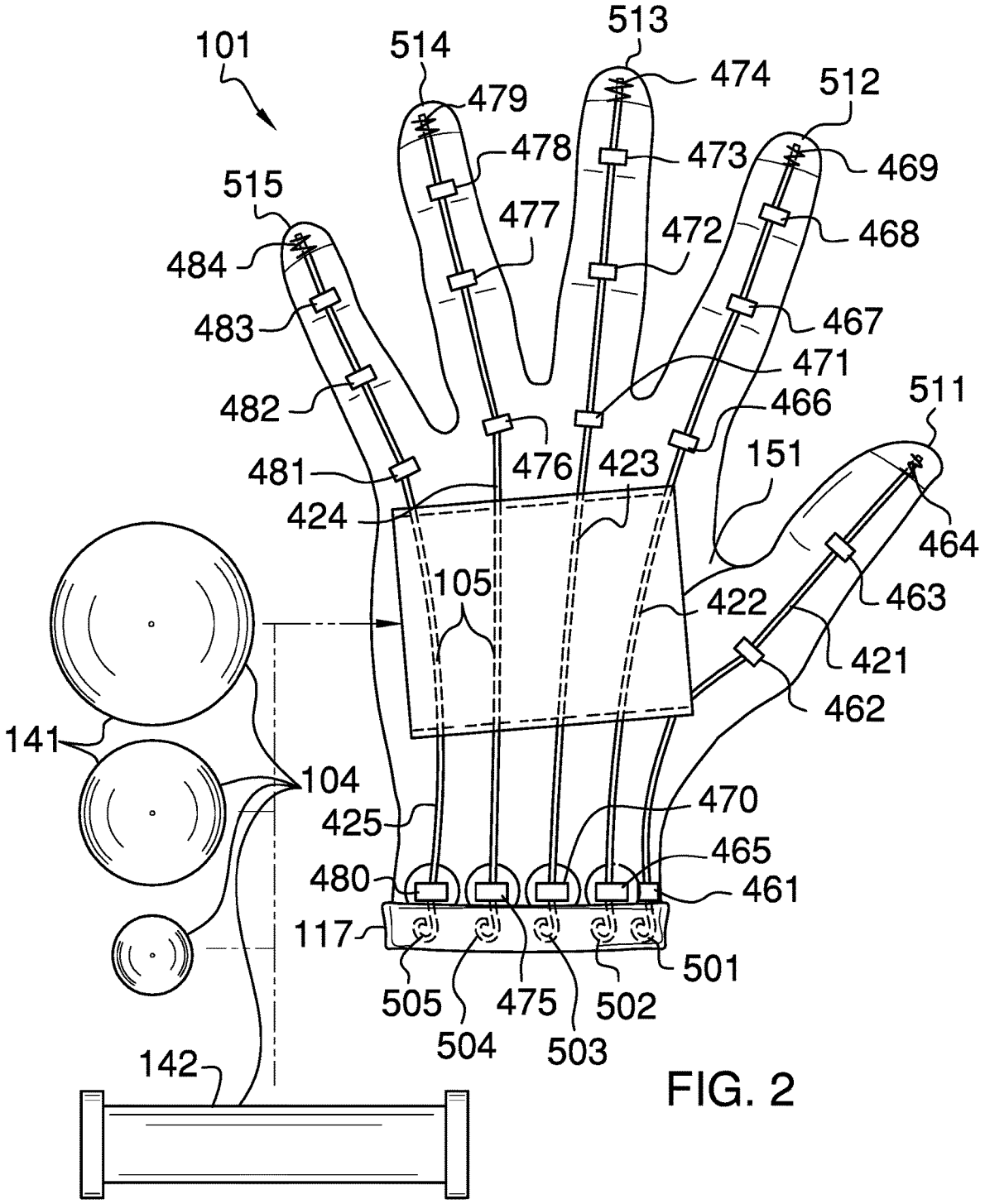
FIG. 2 is a front side view of an embodiment of the disclosure.
Figure 3:
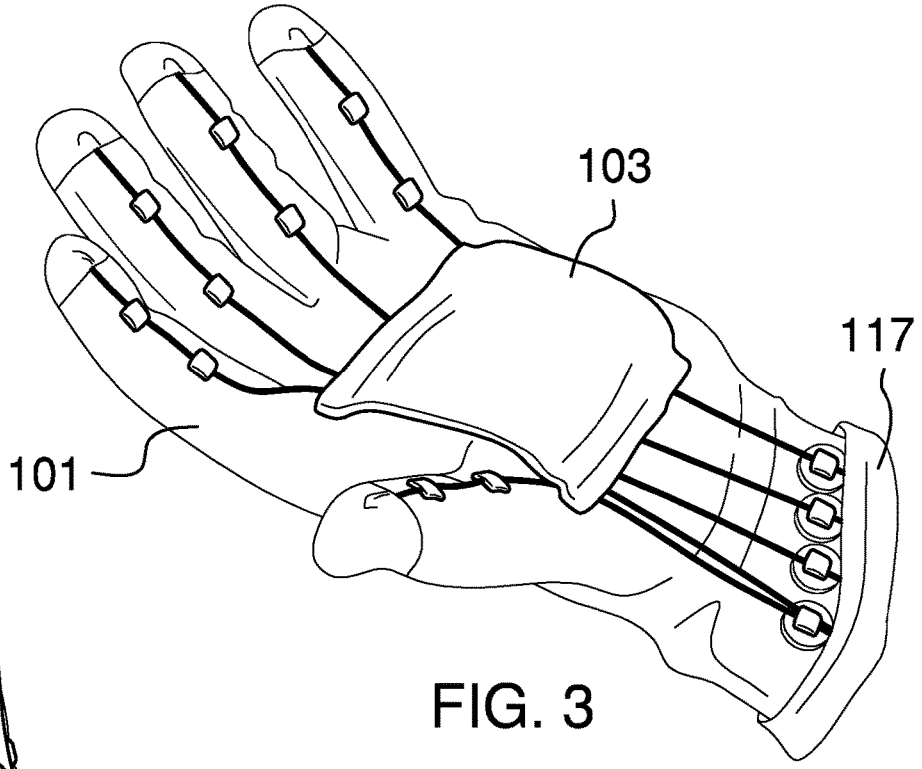
FIG. 3 is a perspective view of an embodiment of the disclosure.
Figure 4:
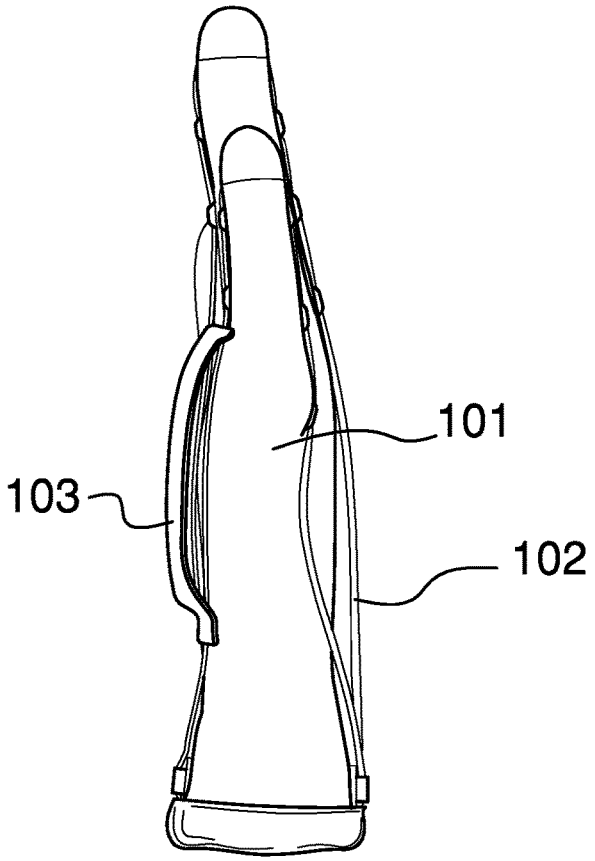
FIG. 4 is a side view of an embodiment of the disclosure.
Figure 5:
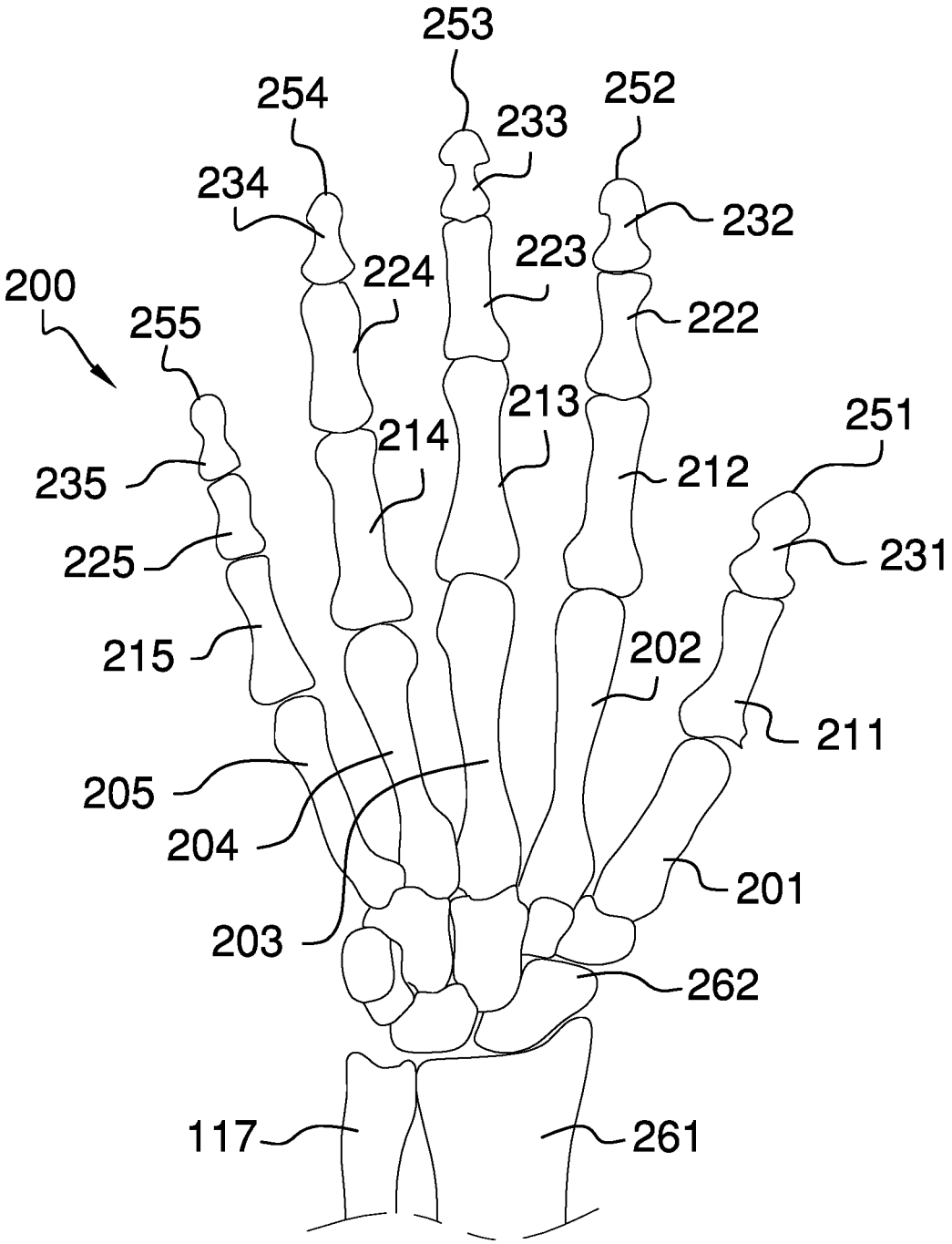
FIG. 5 is a detail view related to an embodiment of the disclosure.

Detailed reference will now be made to one or more potential embodiments of the disclosure, which are illustrated in FIGS. 1 through 5.

The resistance exercise glove 100 (hereinafter invention) is configured for use with a patient. The patient is further defined with a hand 200. The invention 100 is a garment worn on the hand 200. The invention 100 is a therapeutic device. The invention 100 exercises the hand 200 by providing an opposing force that works against the movement of the hand 200. The opposing force provides a resistance based therapeutic exercise that strengthens the hand 200. The invention 100 comprises a glove 101, a plurality of rear side 152 resistance bands 102, a pocket 103, and a squeeze device 104, and a plurality of front side 151 resistance bands 102. The glove 101 is further defined with a front side 151, a rear side 152, and an opening 153.

The hand 200 inserts into the glove 101 through the opening 153. The plurality of rear side 152 resistance bands 102 attach to the rear side 152 of the glove 101 such that each of the rear side 152 resistance bands opposes the bending of a finger selected from the group consisting of the first finger 251, the second finger 252, the third finger 253, the fourth finger 254, and the fifth finger 255. The plurality of front side 151 resistance bands 102 attach to the front side 151 of the glove 101 such that each of the rear side 152 resistance bands opposes the extension of a finger selected from the group consisting of the first finger 251, the second finger 252, the third finger 253, the fourth finger 254, and the fifth finger 255. The pocket 103 is formed on the front side 151 of the glove 101. The pocket 103 contains the squeeze device 104. The squeeze device 104 is an elastomeric device that opposes the squeezing motion of the hand 200.

As described in greater detail elsewhere in this disclosure, the first finger 251 is further defined with a first metacarpal 201, a first proximal phalange 211, and a first distal phalange 231. The second finger 252 is further defined with a second metacarpal 202, a second proximal phalange 212, a second intermediate phalange 222, and a second distal phalange 232. The third finger 253 is further defined with a third metacarpal 203, a third proximal phalange 213, a third intermediate phalange 223, and a third distal phalange 233. The fourth finger 254 is further defined with a fourth metacarpal 204, a fourth proximal phalange 214, a fourth intermediate phalange 224, and a fourth distal phalange 234. The fifth finger 255 is further defined with a fifth metacarpal 205, a fifth proximal phalange 215, a fifth intermediate phalange 225, and a fifth distal phalange 235.

The glove 101 is a garment worn on the hand 200. The glove 101 is formed from an elastic textile. The glove 101 acts as a spring. Specifically, when the hand 200 inserts into the glove 101, a radial force is applied to the glove 101 in a direction away from the center axis of the glove 101. The applied radial force elongates the span of the glove 101 in the direction away from the center of the glove 101. The elasticity of the glove 101 creates a force that opposes the displacement created by the applied force. The elasticity of the glove 101 returns the glove 101 to its relaxed shape. The hand 200 will prevent the glove 101 from returning to its relaxed shape. In this circumstance, the glove 101 will apply a force projecting radially towards the center of the glove 101 that binds the glove 101 to the hand 200.

The glove 101 comprises a first finger stall 111, a second finger stall 112, a third finger stall 113, a fourth finger stall 114, a fifth finger stall 115, a trank 116, and a band pouch 117. The glove 101 is further defined with a front side 151, a rear side 152, and an opening 153. The front side 151 is described in greater detail elsewhere in this disclosure. The rear side 152 is described in greater detail elsewhere in this disclosure. The opening 153 is an aperture formed in the glove 101. The hand 200 inserts into the glove 101 through the opening 153.

The first finger stall 111, the second finger stall 112, the third finger stall 113, the fourth finger stall 114, the fifth finger stall 115, and the trank 116 are described in greater detail elsewhere in this disclosure.

The band pouch 117 is a rouleau formed around the exterior surface of the opening 153 of the glove 101. The band pouch 117 forms a channel in which the proximal end of each of the plurality of rear side 152 resistance bands 102 and each of the plurality of front side 151 resistance bands 105 are stored after the tension of each selected resistance band.

Methods to design and manufacture a glove 101 are well-known and documented in the apparel and textile arts.

Each of the plurality of rear side 152 resistance bands 102 is an elastic structure. Each of the plurality of rear side 152 resistance bands 102 attaches to the glove 101. Each of the plurality of rear side 152 resistance bands 102 corresponds to a finger selected from the group consisting of the first finger 251, the second finger 252, the third finger 253, the fourth finger 254, and the fifth finger 255. Each of the plurality of rear side 152 resistance bands 102 provides a force that opposes the motion of the selected finger associated with each of the plurality of rear side 152 resistance bands 102.

Each of the plurality of rear side 152 resistance bands 102 acts as a spring. Specifically, when a force is applied to both ends of each of the plurality of rear side 152 resistance bands 102 in a direction corresponding to the center axis of each of the plurality of rear side 152 resistance bands 102, the applied force elongates the span of the end to end length each of the plurality of rear side 152 resistance bands 102 in the direction corresponding to the center axis of each of the plurality of rear side 152 resistance bands 102. The elasticity of each of the plurality of rear side 152 resistance bands 102 creates a force that opposes the displacement created by the applied force. The elasticity of each of the plurality of rear side 152 resistance bands 102 returns each of the plurality of rear side 152 resistance bands 102 to its relaxed shape.

The bending of the finger associated with each of the plurality of rear side 152 resistance bands 102 will prevent each of the plurality of rear side 152 resistance bands 102 from returning to its relaxed shape. In this circumstance, each of the plurality of rear side 152 resistance bands 102 will apply a force resisting the movement of the finger associated with any selected rear side 152 resistance band.

The tension of each of the plurality of rear side 152 resistance bands 102 is individually adjustable. The tension on each plurality of rear side 152 resistance bands 102 in in a relaxed shape when the hand 200 is fully extended.

Each of the plurality of rear side 152 resistance bands 102 is selected from the group consisting of an elastic cord or an elastic webbing.

The plurality of rear side 152 resistance bands 102 comprises a first rear side 152 resistance band 121, a second rear side 152 resistance band 122, a third rear side 152 resistance band 123, a fourth rear side 152 resistance band 124, and a fifth rear side 152 resistance band 125. The first rear side 152 resistance band 121 is further defined with a first rear side 152 proximal end 301 and a first rear side 152 distal end 311. The second rear side 152 resistance band 122 is further defined with a second rear side 152 proximal end 302 and a second rear side 152 distal end 312. The third rear side 152 resistance band 123 is further defined with a third rear side 152 proximal end 303 and a third rear side 152 distal end 313. The fourth rear side 152 resistance band 124 is further defined with a fourth rear side 152 proximal end 304 and a fourth rear side 152 distal end 314. The fifth rear side 152 resistance band 125 is further defined with a fifth rear side 152 proximal end 305 and a fifth rear side 152 distal end 315.

The first rear side 152 resistance band 121 is the rear side 152 resistance band selected from the plurality of rear side 152 resistance bands 102 associated with the first finger 251. The first rear side 152 resistance band 121 attaches to the glove 101 such that the first rear side 152 resistance band 121 aligns with the first metacarpal 201, the first proximal phalange 211, and the first distal phalange 231. The first rear side 152 resistance band 121 further comprises a first rear side 152 band stay 161, a second rear side 152 band stay 162, a third rear side 152 band stay 163, and a fourth rear side 152 band stay 164.

The first rear side 152 band stay 161 is a cord lock. The first rear side 152 band stay 161 attaches the first rear side 152 proximal end 301 of the first rear side 152 resistance band 121 to the glove 101. The first rear side 152 band stay 161 controls the tension of the first rear side 152 resistance band 121. The second rear side 152 band stay 162 is a tape that attaches the first rear side 152 resistance band 121 to the glove 101. The third rear side 152 band stay 163 is a tape that attaches the first rear side 152 resistance band 121 to the glove 101. The fourth rear side 152 band stay 164 is a sewn seam. The fourth rear side 152 band stay 164 attaches the first rear side 152 distal end 311 of the first rear side 152 resistance band 121 to the glove 101.

The second rear side 152 resistance band 122 is the rear side 152 resistance band selected from the plurality of rear side 152 resistance bands 102 associated with the second finger 252. The second rear side 152 resistance band 122 attaches to the glove 101 such that the second rear side 152 resistance band 122 aligns with the second metacarpal 202, the second proximal phalange 212, the second intermediate phalange 222, and the second distal phalange 232. The second rear side 152 resistance band 122 further comprises a fifth rear side 152 band stay 165, a sixth rear side 152 band stay 166, a seventh rear side 152 band stay 167, an eighth rear side 152 band stay 168, and a ninth rear side 152 band stay 169.

The fifth rear side 152 band stay 165 is a cord lock. The fifth rear side 152 band stay 165 attaches the second rear side 152 proximal end 302 of the second rear side 152 resistance band 122 to the glove 101. The fifth rear side 152 band stay 165 controls the tension of the second rear side 152 resistance band 122. The sixth rear side 152 band stay 166 is a tape that attaches the second rear side 152 resistance band 122 to the glove 101. The seventh rear side 152 band stay 167 is a tape that attaches the second rear side 152 resistance band 122 to the glove 101. The eighth rear side 152 band stay 168 is a tape that attaches the second rear side 152 resistance band 122 to the glove 101. The ninth rear side 152 band stay 169 is a sewn seam. The ninth rear side 152 band stay 169 attaches the second rear side 152 distal end 312 of the second rear side 152 resistance band 122 to the glove 101.

The third rear side 152 resistance band 123 is the rear side 152 resistance band selected from the plurality of rear side 152 resistance bands 102 associated with the third finger 253. The third rear side 152 resistance band 123 attaches to the glove 101 such that the third rear side 152 resistance band 123 aligns with the third metacarpal 203, the third proximal phalange 213, the third intermediate phalange 223, and the third distal phalange 233. The third rear side 152 resistance band 123 further comprises a tenth rear side 152 band stay 170, an eleventh rear side 152 band stay 171, a twelfth rear side 152 band stay 172, a thirteenth rear side 152 band stay 173, and a fourteenth rear side 152 band stay 174.

The tenth rear side 152 band stay 170 is a cord lock. The tenth rear side 152 band stay 170 attaches the third rear side 152 proximal end 303 of the third rear side 152 resistance band 123 to the glove 101. The tenth rear side 152 band stay 170 controls the tension of the third rear side 152 resistance band 123. The eleventh rear side 152 band stay 171 is a tape that attaches the third rear side 152 resistance band 123 to the glove 101. The twelfth rear side 152 band stay 172 is a tape that attaches the third rear side 152 resistance band 123 to the glove 101. The thirteenth rear side 152 band stay 173 is a tape that attaches the third rear side 152 resistance band 123 to the glove 101. The fourteenth rear side 152 band stay 174 is a sewn seam. The fourteenth rear side 152 band stay 174 attaches the third rear side 152 distal end 313 of the third rear side 152 resistance band 123 to the glove 101.

The fourth rear side 152 resistance band 124 is the rear side 152 resistance band selected from the plurality of rear side 152 resistance bands 102 associated with the fourth finger 254. The fourth rear side 152 resistance band 124 attaches to the glove 101 such that the fourth rear side 152 resistance band 124 aligns with the fourth metacarpal 204, the fourth proximal phalange 214, the fourth intermediate phalange 224, and the fourth distal phalange 234. The fourth rear side 152 resistance band 124 further comprises a fifteenth rear side 152 band stay 175, a sixteenth rear side 152 band stay 176, a seventeenth rear side 152 band stay 177, an eighteenth rear side 152 band stay 178, and a nineteenth rear side 152 band stay 179.

The fifteenth rear side 152 band stay 175 is a cord lock. The fifteenth rear side 152 band stay 175 attaches the fourth rear side 152 proximal end 304 of the fourth rear side 152 resistance band 124 to the glove 101. The fifteenth rear side 152 band stay 175 controls the tension of the fourth rear side 152 resistance band 124. The sixteenth rear side 152 band stay 176 is a tape that attaches the fourth rear side 152 resistance band 124 to the glove 101. The seventeenth rear side 152 band stay 177 is a tape that attaches the fourth rear side 152 resistance band 124 to the glove 101. The eighteenth rear side 152 band stay 178 is a tape that attaches the fourth rear side 152 resistance band 124 to the glove 101. The nineteenth rear side 152 band stay 179 is a sewn seam. The nineteenth rear side 152 band stay 179 attaches the fourth rear side 152 distal end 314 of the fourth rear side 152 resistance band 124 to the glove 101.

The fifth rear side 152 resistance band 125 is the rear side 152 resistance band selected from the plurality of rear side 152 resistance bands 102 associated with the fifth finger 255. The fifth rear side 152 resistance band 125 attaches to the glove 101 such that the fifth rear side 152 resistance band 125 aligns with the fifth metacarpal 205, the fifth proximal phalange 215, the fifth intermediate phalange 225, and the fifth distal phalange 235. The fifth rear side 152 resistance band 125 further comprises a twentieth rear side 152 band stay 180, a twenty-first rear side 152 band stay 181, a twenty-second rear side 152 band stay 182, a twenty-third rear side 152 band stay 183, and a twenty-fourth rear side 152 band stay 184.

The twentieth rear side 152 band stay 180 is a cord lock. The twentieth rear side 152 band stay 180 attaches the fifth rear side 152 proximal end 305 of the fifth rear side 152 resistance band 125 to the glove 101. The twentieth rear side 152 band stay 180 controls the tension of the fifth rear side 152 resistance band 125. The twenty-first rear side 152 band stay 181 is a tape that attaches the fifth rear side 152 resistance band 125 to the glove 101. The twenty-second rear side 152 band stay 182 is a tape that attaches the fifth rear side 152 resistance band 125 to the glove 101. The twenty-third rear side 152 band stay 183 is a tape that attaches the fifth rear side 152 resistance band 125 to the glove 101. The twenty-fourth rear side 152 band stay 184 is a sewn seam. The twenty-fourth rear side 152 band stay 184 attaches the fifth rear side 152 distal end 315 of the fifth rear side 152 resistance band 125 to the glove 101.

Each of the plurality of front side 151 resistance bands 105 is an elastic structure. Each of the plurality of front side 151 resistance bands 105 attaches to the glove 101. Each of the plurality of front side 151 resistance bands 105 corresponds to a finger selected from the group consisting of the first finger 251, the second finger 252, the third finger 253, the fourth finger 254, and the fifth finger 255. Each of the plurality of front side 151 resistance bands 105 provides a force that opposes the motion of the selected finger associated with each of the plurality of front side 151 resistance bands 105.

Each of the plurality of front side 151 resistance bands 105 acts as a spring. Specifically, when a force is applied to both ends of each of the plurality of front side 151 resistance bands 105 in a direction corresponding to the center axis of each of the plurality of front side 151 resistance bands 105, the applied force elongates the span of the end to end length each of the plurality of front side 151 resistance bands 105 in the direction corresponding to the center axis of each of the plurality of front side 151 resistance bands 105. The elasticity of each of the plurality of front side 151 resistance bands 105 creates a force that opposes the displacement created by the applied force. The elasticity of each of the plurality of front side 151 resistance bands 105 returns each of the plurality of front side 151 resistance bands 105 to its relaxed shape.

The bending of the finger associated with each of the plurality of front side 151 resistance bands 105 will prevent each of the plurality of front side 151 resistance bands 105 from returning to its relaxed shape. In this circumstance, each of the plurality of front side 151 resistance bands 105 will apply a force resisting the movement of the finger associated with any selected front side 151 resistance band.

The tension of each of the plurality of front side 151 resistance bands 105 is individually adjustable. The tension on each front side 151 resistance band 105 in in a relaxed shape when the hand 200 forms a fist.

Each of the plurality of front side 151 resistance bands 105 is selected from the group consisting of an elastic cord or an elastic webbing.

The plurality of front side 151 resistance bands 105 comprises a first front side 151 resistance band 421, a second front side 151 resistance band 422, a third front side 151 resistance band 423, a fourth front side 151 resistance band 424, and a fifth front side 151 resistance band 425. The first front side 151 resistance band 421 is further defined with a first front side 151 proximal end 501 and a first front side 151 distal end 511. The second front side 151 resistance band 422 is further defined with a second front side 151 proximal end 502 and a second front side 151 distal end 512. The third front side 151 resistance band 423 is further defined with a third front side 151 proximal end 503 and a third front side 151 distal end 513. The fourth front side 151 resistance band 424 is further defined with a fourth front side 151 proximal end 504 and a fourth front side 151 distal end 514. The fifth front side 151 resistance band 425 is further defined with a fifth front side 151 proximal end 505 and a fifth front side 151 distal end 515.

The first front side 151 resistance band 421 is the front side 151 resistance band selected from the plurality of front side 151 resistance bands 105 associated with the first finger 251. The first front side 151 resistance band 421 attaches to the glove 101 such that the first front side 151 resistance band 421 aligns with the first metacarpal 201, the first proximal phalange 211, and the first distal phalange 231. The first front side 151 resistance band 421 further comprises a first front side 151 band stay 461, a second front side 151 band stay 462, a third front side 151 band stay 463, and a fourth front side 151 band stay 464.

The first front side 151 band stay 461 is a cord lock. The first front side 151 band stay 461 attaches the first front side 151 proximal end 501 of the first front side 151 resistance band 421 to the glove 101. The first front side 151 band stay 461 controls the tension of the first front side 151 resistance band 421. The second front side 151 band stay 462 is a tape that attaches the first front side 151 resistance band 421 to the glove 101. The third front side 151 band stay 463 is a tape that attaches the first front side 151 resistance band 421 to the glove 101. The fourth front side 151 band stay 464 is a sewn seam. The fourth front side 151 band stay 464 attaches the first front side 151 distal end 511 of the first front side 151 resistance band 421 to the glove 101.

The second front side 151 resistance band 422 is the front side 151 resistance band selected from the plurality of front side 151 resistance bands 105 associated with the second finger 252. The second front side 151 resistance band 422 attaches to the glove 101 such that the second front side 151 resistance band 422 aligns with the second metacarpal 202, the second proximal phalange 212, the second intermediate phalange 222, and the second distal phalange 232. The second front side 151 resistance band 422 further comprises a fifth front side 151 band stay 465, a sixth front side 151 band stay 466, a seventh front side 151 band stay 467, an eighth front side 151 band stay 468, and a ninth front side 151 band stay 469.

The fifth front side 151 band stay 465 is a cord lock. The fifth front side 151 band stay 465 attaches the second front side 151 proximal end 502 of the second front side 151 resistance band 422 to the glove 101. The fifth front side 151 band stay 465 controls the tension of the second front side 151 resistance band 422. The sixth front side 151 band stay 466 is a tape that attaches the second front side 151 resistance band 422 to the glove 101. The seventh front side 151 band stay 467 is a tape that attaches the second front side 151 resistance band 422 to the glove 101. The eighth front side 151 band stay 468 is a tape that attaches the second front side 151 resistance band 422 to the glove 101. The ninth front side 151 band stay 469 is a sewn seam. The ninth front side 151 band stay 469 attaches the second front side 151 distal end 512 of the second front side 151 resistance band 422 to the glove 101.

The third front side 151 resistance band 423 is the front side 151 resistance band selected from the plurality of front side 151 resistance bands 105 associated with the third finger 253. The third front side 151 resistance band 423 attaches to the glove 101 such that the third front side 151 resistance band 423 aligns with the third metacarpal 203, the third proximal phalange 213, the third intermediate phalange 223, and the third distal phalange 233. The third front side 151 resistance band 423 further comprises a tenth front side 151 band stay 470, an eleventh front side 151 band stay 471, a twelfth front side 151 band stay 472, a thirteenth front side 151 band stay 473, and a fourteenth front side 151 band stay 474.

The tenth front side 151 band stay 470 is a cord lock. The tenth front side 151 band stay 470 attaches the third front side 151 proximal end 503 of the third front side 151 resistance band 423 to the glove 101. The tenth front side 151 band stay 470 controls the tension of the third front side 151 resistance band 423. The eleventh front side 151 band stay 471 is a tape that attaches the third front side 151 resistance band 423 to the glove 101. The twelfth front side 151 band stay 472 is a tape that attaches the third front side 151 resistance band 423 to the glove 101. The thirteenth front side 151 band stay 473 is a tape that attaches the third front side 151 resistance band 423 to the glove 101. The fourteenth front side 151 band stay 474 is a sewn seam. The fourteenth front side 151 band stay 474 attaches the third front side 151 distal end 513 of the third front side 151 resistance band 423 to the glove 101.

The fourth front side 151 resistance band 424 is the front side 151 resistance band selected from the plurality of front side 151 resistance bands 105 associated with the fourth finger 254. The fourth front side 151 resistance band 424 attaches to the glove 101 such that the fourth front side 151 resistance band 424 aligns with the fourth metacarpal 204, the fourth proximal phalange 214, the fourth intermediate phalange 224, and the fourth distal phalange 234. The fourth front side 151 resistance band 424 further comprises a fifteenth front side 151 band stay 475, a sixteenth front side 151 band stay 476, a seventeenth front side 151 band stay 477, an eighteenth front side 151 band stay 478, and a nineteenth front side 151 band stay 479.

The fifteenth front side 151 band stay 475 is a cord lock. The fifteenth front side 151 band stay 475 attaches the fourth front side 151 proximal end 504 of the fourth front side 151 resistance band 424 to the glove 101. The fifteenth front side 151 band stay 475 controls the tension of the fourth front side 151 resistance band 424. The sixteenth front side 151 band stay 476 is a tape that attaches the fourth front side 151 resistance band 424 to the glove 101. The seventeenth front side 151 band stay 477 is a tape that attaches the fourth front side 151 resistance band 424 to the glove 101. The eighteenth front side 151 band stay 478 is a tape that attaches the fourth front side 151 resistance band 424 to the glove 101. The nineteenth front side 151 band stay 479 is a sewn seam. The nineteenth front side 151 band stay 479 attaches the fourth front side 151 distal end 514 of the fourth front side 151 resistance band 424 to the glove 101.

The fifth front side 151 resistance band 425 is the front side 151 resistance band selected from the plurality of front side 151 resistance bands 105 associated with the fifth finger 255. The fifth front side 151 resistance band 425 attaches to the glove 101 such that the fifth front side 151 resistance band 425 aligns with the fifth metacarpal 205, the fifth proximal phalange 215, the fifth intermediate phalange 225, and the fifth distal phalange 235. The fifth front side 151 resistance band 425 further comprises a twentieth front side 151 band stay 480, a twenty-first front side 151 band stay 481, a twenty-second front side 151 band stay 482, a twenty-third front side 151 band stay 483, and a twenty-fourth front side 151 band stay 484.

The twentieth front side 151 band stay 480 is a cord lock. The twentieth front side 151 band stay 480 attaches the fifth front side 151 proximal end 505 of the fifth front side 151 resistance band 425 to the glove 101. The twentieth front side 151 band stay 480 controls the tension of the fifth front side 151 resistance band 425. The twenty-first front side 151 band stay 481 is a tape that attaches the fifth front side 151 resistance band 425 to the glove 101. The twenty-second front side 151 band stay 482 is a tape that attaches the fifth front side 151 resistance band 425 to the glove 101. The twenty-third front side 151 band stay 483 is a tape that attaches the fifth front side 151 resistance band 425 to the glove 101. The twenty-fourth front side 151 band stay 484 is a sewn seam. The twenty-fourth front side 151 band stay 484 attaches the fifth front side 151 distal end 515 of the fifth front side 151 resistance band 425 to the glove 101.

The pocket 103 is a storage space formed on the glove 101. The pocket 103 comprises a sheeting 131 and a plurality of pocket seams 132. The sheeting 131 is a sheeting 131 that attaches to the trank 116 of the glove 101 over the palm of the hand 200. The sheeting 131 forms the exterior surface of the pocket 103. Each of the plurality of pocket seams 132 is a seam that attaches the sheeting 131 to the trank 116 of the glove 101. Methods to form seams are well-known and documented in the textile and apparel arts.

The squeeze device 104 is an elastomeric structure. The squeeze device 104 is sized to fit into the pocket 103. The elastomeric structure of the squeeze device 104 opposes compressive forces when the hand 200 squeezes the squeeze device 104. The squeeze device 104 provides a force that opposes the grasping motion of the hand 200 when the glove 101 is worn. The squeeze device 104 is selected from the group consisting of one or more elastomeric spheres 141 and an elastomeric cylinder 142.

Each of the one or more elastomeric spheres 141 is a sphere formed from an elastomeric material. Each of the one or more elastomeric spheres 141 opposes compressive forces when squeezed. The difference between any first elastomeric sphere selected from the one or more elastomeric spheres 141 and a second elastomeric sphere selected from the one or more elastomeric spheres 141 is the radius of the selected elastomeric spheres.

The elastomeric cylinder 142 is a cylindrical structure formed from an elastomeric material. The elastomeric cylinder 142 opposes compressive forces when squeezed.

The following twenty-two paragraphs describe the assembly of the invention 100.

The first finger stall 111 attaches to the trank 116 such that the first finger 251 inserts into the first finger stall 111 when the hand 200 inserts into the opening 153 of the glove 101. The second finger stall 112 attaches to the trank 116 such that the second finger 252 inserts into the second finger stall 112 when the hand 200 inserts into the opening 153 of the glove 101. The third finger stall 113 attaches to the trank 116 such that the third finger 253 inserts into the third finger stall 113 when the hand 200 inserts into the opening 153 of the glove 101. The fourth finger stall 114 attaches to the trank 116 such that the fourth finger 254 inserts into the fourth finger stall 114 when the hand 200 inserts into the opening 153 of the glove 101. The fifth finger stall 115 attaches to the trank 116 such that the fifth finger 255 inserts into the fifth finger stall 115 when the hand 200 inserts into the opening 153 of the glove 101.

The first rear side 152 band stay 161 attaches the first rear side 152 proximal end 301 of the first rear side 152 resistance band 121 to the rear side 152 of the glove 101 at the location identified by the joint that joins the proximal end of the first metacarpal 201 to the wrist 260. The fourth rear side 152 band stay 164 attaches the first rear side 152 distal end 311 of the first rear side 152 resistance band 121 to the rear side 152 of the glove 101 at the location identified as the distal end of the first distal phalange 231.

The second rear side 152 band stay 162 attaches the first rear side 152 resistance band 121 to the rear side 152 of the glove 101 at the location identified as the interphalangeal joint between the first metacarpal 201 and the first proximal phalange 211. The third rear side 152 band stay 163 attaches the first rear side 152 resistance band 121 to the rear side 152 of the glove 101 at the location identified as the interphalangeal joint between the first proximal phalange 211 and the first distal phalange 231.

The fifth rear side 152 band stay 165 attaches the second rear side 152 proximal end 302 of the second rear side 152 resistance band 122 to the rear side 152 of the glove 101 at the location identified by the joint that joins the proximal end of the second metacarpal 202 to the wrist 260. The ninth rear side 152 band stay 169 attaches the second rear side 152 distal end 312 of the second rear side 152 resistance band 122 to the rear side 152 of the glove 101 at the location identified as the distal end of the second distal phalange 232.

The sixth rear side 152 band stay 166 attaches the second rear side 152 resistance band 122 to the rear side 152 of the glove 101 at the location identified as the interphalangeal joint between the second metacarpal 202 and the second proximal phalange 212. The seventh rear side 152 band stay 167 attaches the second rear side 152 resistance band 122 to the rear side 152 of the glove 101 at the location identified as the interphalangeal joint between the second proximal phalange 212 and the second intermediate phalange 222. The eighth rear side 152 band stay 168 attaches the second rear side 152 resistance band 122 to the rear side 152 of the glove 101 at the location identified as the interphalangeal joint between the second intermediate phalange 222 and the second distal phalange 232.

The tenth rear side 152 band stay 170 attaches the third rear side 152 proximal end 303 of the third rear side 152 resistance band 123 to the rear side 152 of the glove 101 at the location identified by the joint that joins the proximal end of the third metacarpal 203 to the wrist 260. The fourteenth rear side 152 band stay 174 attaches the third rear side 152 distal end 313 of the third rear side 152 resistance band 123 to the rear side 152 of the glove 101 at the location identified as the distal end of the third distal phalange 233.

The eleventh rear side 152 band stay 171 attaches the third rear side 152 resistance band 123 to the rear side 152 of the glove 101 at the location identified as the interphalangeal joint between the third metacarpal 203 and the third proximal phalange 213. The twelfth rear side 152 band stay 172 attaches the third rear side 152 resistance band 123 to the rear side 152 of the glove 101 at the location identified as the interphalangeal joint between the third proximal phalange 213 and the third intermediate phalange 223. The thirteenth rear side 152 band stay 173 attaches the third rear side 152 resistance band 123 to the rear side 152 of the glove 101 at the location identified as the interphalangeal joint between the third intermediate phalange 223 and the third distal phalange 233.

The fifteenth rear side 152 band stay 175 attaches the fourth rear side 152 proximal end 304 of the fourth rear side 152 resistance band 124 to the rear side 152 of the glove 101 at the location identified by the joint that joins the proximal end of the fourth metacarpal 204 to the wrist 260. The nineteenth rear side 152 band stay 179 attaches the fourth rear side 152 distal end 314 of the fourth rear side 152 resistance band 124 to the rear side 152 of the glove 101 at the location identified as the distal end of the fourth distal phalange 234.

The sixteenth rear side 152 band stay 176 attaches the fourth rear side 152 resistance band 124 to the rear side 152 of the glove 101 at the location identified as the interphalangeal joint between the fourth metacarpal 204 and the fourth proximal phalange 214. The seventeenth rear side 152 band stay 177 attaches the fourth rear side 152 resistance band 124 to the rear side 152 of the glove 101 at the location identified as the interphalangeal joint between the fourth proximal phalange 214 and the fourth intermediate phalange 224. The eighteenth rear side 152 band stay 178 attaches the fourth rear side 152 resistance band 124 to the rear side 152 of the glove 101 at the location identified as the interphalangeal joint between the fourth intermediate phalange 224 and the fourth distal phalange 234.

The twentieth rear side 152 band stay 180 attaches the fifth rear side 152 proximal end 305 of the fifth rear side 152 resistance band 125 to the rear side 152 of the glove 101 at the location identified by the joint that joins the proximal end of the fifth metacarpal 205 to the wrist 260. The twenty-fourth rear side 152 band stay 184 attaches the fifth rear side 152 distal end 315 of the fifth rear side 152 resistance band 125 to the rear side 152 of the glove 101 at the location identified as the distal end of the fifth distal phalange 235.

The twenty-first rear side 152 band stay 181 attaches the fifth rear side 152 resistance band 125 to the rear side 152 of the glove 101 at the location identified as the interphalangeal joint between the fifth metacarpal 205 and the fifth proximal phalange 215. The twenty-second rear side 152 band stay 182 attaches the fifth rear side 152 resistance band 125 to the rear side 152 of the glove 101 at the location identified as the interphalangeal joint between the fifth proximal phalange 215 and the fifth intermediate phalange 225. The twenty-third rear side 152 band stay 183 attaches the fifth rear side 152 resistance band 125 to the rear side 152 of the glove 101 at the location identified as the interphalangeal joint between the fifth intermediate phalange 225 and the fifth distal phalange 235.

The first front side 151 band stay 461 attaches the first front side 151 proximal end 501 of the first front side 151 resistance band 421 to the front side 151 of the glove 101 at the location identified by the joint that joins the proximal end of the first metacarpal 201 to the wrist 260. The fourth front side 151 band stay 464 attaches the first front side 151 distal end 511 of the first front side 151 resistance band 421 to the front side 151 of the glove 101 at the location identified as the distal end of the first distal phalange 231.

The second front side 151 band stay 462 attaches the first front side 151 resistance band 421 to the front side 151 of the glove 101 at the location identified as the interphalangeal joint between the first metacarpal 201 and the first proximal phalange 211. The third front side 151 band stay 463 attaches the first front side 151 resistance band 421 to the front side 151 of the glove 101 at the location identified as the interphalangeal joint between the first proximal phalange 211 and the first distal phalange 231.

The fifth front side 151 band stay 465 attaches the second front side 151 proximal end 502 of the second front side 151 resistance band 422 to the front side 151 of the glove 101 at the location identified by the joint that joins the proximal end of the second metacarpal 202 to the wrist 260. The ninth front side 151 band stay 469 attaches the second front side 151 distal end 512 of the second front side 151 resistance band 422 to the front side 151 of the glove 101 at the location identified as the distal end of the second distal phalange 232.

The sixth front side 151 band stay 466 attaches the second front side 151 resistance band 422 to the front side 151 of the glove 101 at the location identified as the interphalangeal joint between the second metacarpal 202 and the second proximal phalange 212. The seventh front side 151 band stay 467 attaches the second front side 151 resistance band 422 to the front side 151 of the glove 101 at the location identified as the interphalangeal joint between the second proximal phalange 212 and the second intermediate phalange 222. The eighth front side 151 band stay 468 attaches the second front side 151 resistance band 422 to the front side 151 of the glove 101 at the location identified as the interphalangeal joint between the second intermediate phalange 222 and the second distal phalange 232.

The tenth front side 151 band stay 470 attaches the third front side 151 proximal end 503 of the third front side 151 resistance band 423 to the front side 151 of the glove 101 at the location identified by the joint that joins the proximal end of the third metacarpal 203 to the wrist 260. The fourteenth front side 151 band stay 474 attaches the third front side 151 distal end 513 of the third front side 151 resistance band 423 to the front side 151 of the glove 101 at the location identified as the distal end of the third distal phalange 233.

The eleventh front side 151 band stay 471 attaches the third front side 151 resistance band 423 to the front side 151 of the glove 101 at the location identified as the interphalangeal joint between the third metacarpal 203 and the third proximal phalange 213. The twelfth front side 151 band stay 472 attaches the third front side 151 resistance band 423 to the front side 151 of the glove 101 at the location identified as the interphalangeal joint between the third proximal phalange 213 and the third intermediate phalange 223. The thirteenth front side 151 band stay 473 attaches the third front side 151 resistance band 423 to the front side 151 of the glove 101 at the location identified as the interphalangeal joint between the third intermediate phalange 223 and the third distal phalange 233.

The fifteenth front side 151 band stay 475 attaches the fourth front side 151 proximal end 504 of the fourth front side 151 resistance band 424 to the front side 151 of the glove 101 at the location identified by the joint that joins the proximal end of the fourth metacarpal 204 to the wrist 260. The nineteenth front side 151 band stay 479 attaches the fourth front side 151 distal end 514 of the fourth front side 151 resistance band 424 to the front side 151 of the glove 101 at the location identified as the distal end of the fourth distal phalange 234.

The sixteenth front side 151 band stay 476 attaches the fourth front side 151 resistance band 424 to the front side 151 of the glove 101 at the location identified as the interphalangeal joint between the fourth metacarpal 204 and the fourth proximal phalange 214. The seventeenth front side 151 band stay 477 attaches the fourth front side 151 resistance band 424 to the front side 151 of the glove 101 at the location identified as the interphalangeal joint between the fourth proximal phalange 214 and the fourth intermediate phalange 224. The eighteenth front side 151 band stay 478 attaches the fourth front side 151 resistance band 424 to the front side 151 of the glove 101 at the location identified as the interphalangeal joint between the fourth intermediate phalange 224 and the fourth distal phalange 234.

The twentieth front side 151 band stay 480 attaches the fifth front side 151 proximal end 505 of the fifth front side 151 resistance band 425 to the front side 151 of the glove 101 at the location identified by the joint that joins the proximal end of the fifth metacarpal 205 to the wrist 260. The twenty-fourth front side 151 band stay 484 attaches the fifth front side 151 distal end 515 of the fifth front side 151 resistance band 425 to the front side 151 of the glove 101 at the location identified as the distal end of the fifth distal phalange 235.

The twenty-first front side 151 band stay 481 attaches the fifth front side 151 resistance band 425 to the front side 151 of the glove 101 at the location identified as the interphalangeal joint between the fifth metacarpal 205 and the fifth proximal phalange 215. The twenty-second front side 151 band stay 482 attaches the fifth front side 151 resistance band 425 to the front side 151 of the glove 101 at the location identified as the interphalangeal joint between the fifth proximal phalange 215 and the fifth intermediate phalange 225. The twenty-third front side 151 band stay 483 attaches the fifth front side 151 resistance band 425 to the front side 151 of the glove 101 at the location identified as the interphalangeal joint between the fifth intermediate phalange 225 and the fifth distal phalange 235.

The plurality of pocket seams 132 attaches the sheeting 131 to the front side 151 of the trank 116 of the glove 101 such that the squeeze device 104 inserts into the pocket 103 between the sheeting 131 and the trank 116.

The following definitions were used in this disclosure:

Bind: As used in this disclosure, to bind is a verb that means to tie or secure a first object to a second object by wrapping a third object around the first object and the second object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Compress: In this disclosure, compress means to force into a smaller space.

Cord: As used in this disclosure, a cord is a long, thin, flexible, and prism-shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Cord Lock: As used in this disclosure, a cord lock is a device that is used to tighten cords, drawstrings, and webbings without the use of knots.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Elastic: As used in this disclosure, an elastic is a material or object that deforms when a force is applied to it and that is able to return to its relaxed shape after the force is removed. A material that exhibits these qualities is also referred to as an elastomeric material.

Elastic Cord: As used in this disclosure, an elastic cord is a cord that contains elastic yarns as some of the yarns that make up the cord. An elastic cord is constructed such that the elastic cord will stretch when a force is applied and will return to its original shape when after the force is removed. Shock cord and bungee cord are synonyms for elastic cord.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Finger Stall: As used in this disclosure, a finger stall refers to: 1) the roughly cylindrical structure associated with a glove into which a finger may be inserted; or, 2) a roughly cylindrical cover, commonly referred to as a finger cot, that is placed directly over a finger to cover the finger.

Glove: As used in this disclosure, a glove is an item of apparel that covers a hand. The glove comprises five finger stalls into which the fingers of the hand are inserted. A glove is further defined with a palm side and a back side. The palm side is proximal to the palm of the hand. The back side is distal from the palm side.

Interphalangeal Joint: As used in this disclosure, the interphalangeal joint refers to: 1) the joint that attaches a first selected phalange to a second selected phalange; or, 2) the joint that attaches a phalange to a metacarpal.

Mirror Image: As used in this disclosure, a mirror image refers to a second object that is a reproduction of a first object wherein the second object is identical to the first object except that the orientation of the second object is reversed relative to the first object as if the second object has been reflected by a plane of a mirror (often called the mirror plane or plane of reflection).

Palm: As used in this disclosure, the palm of the hand is identified as the portions of a left hand and a right hand between the fingers and the wrist that contact each other when the left hand presses against the right hand when the left hand and right hand are in alignment. The palm of the left hand is the mirror image of the palm of the right hand.

Patient: As used in this disclosure, a patient is a person who is designated to receive a medical treatment, therapy or service. The term patient may be extended to an animal when used within the context of the animal receiving veterinary treatment or services Pocket: As used in this disclosure, a pocket is a small pouch or storage space that is formed into an object. Pockets are often formed by joining a second textile or a second sheeting to a first textile or a first sheeting, respectively, by sewing or heat sealing respectively. Methods to form pockets are well-known and documented in the textile and apparel arts.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Purlicue: As used in this disclosure, the purlicue refers to the space between the thumb and the index finger of a hand.

Radial: As used in this disclosure, the term radial refers to a direction that: 1) is perpendicular to an identified central axis; or, 2) projects away from a center point.

Radius: As used in this disclosure, a radius refers to a line segment that: 1) connects the center of a circle to the circumference of the circle; or, 2) connects the center of a sphere to the surface of the sphere; or, 3) is one half the span of the diameter of an object.

Relaxed Shape: As used in this disclosure, a structure is considered to be in its relaxed state when no shear, strain, or torsional forces are being applied to the structure.

Rouleau: As used in this disclosure, a rouleau is a tube or channel that is formed on the edge of a textile or sheeting.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, a sheeting is a material, such as a textile, a plastic, or a metal foil, in the form of a thin flexible layer or layers.

Squeeze: As used in this disclosure, to squeeze means to compress an object by hand.

Stay: As used in this disclosure, a stay is a rope, line, cord, or strap or tape that is used to steady, guide, hold, or secure an object. A common synonym for stay is guy line.

Tape: As used in this disclosure, tape refers to a flexible and narrow strip of textile or sheeting that fastens, secures, or strengthens an object.

Textile: As used in this disclosure, a textile is a material that is woven, knitted, braided or felted. Synonyms in common usage for this definition include fabric and cloth.

Therapeutic: As used in this disclosure, therapeutic is an adjective that refers to a medical, ameliorative, or hygienic substance, process, or procedure.

Trank: As used in this disclosure, the trank refers to the portion of a glove that covers the palm and back of the hand.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A therapeutic device comprising:

a glove defined with a front side, a rear side, and an opening;

a plurality of rear side resistance bands attached to the rear side of the glove;

a plurality of front side resistance bands attached to the front side of the glove;

a squeeze device; and a pocket attaching the squeeze device to the glove;

wherein the therapeutic device is a garment configured to be worn on a hand of a user, whereby the opening of the glove is configured to receive the hand therethrough;

wherein the therapeutic device is configured to provide an opposing force that works against a movement of the hand;

wherein the squeeze device has an elastomeric structure;

wherein the plurality of rear side resistance bands and the plurality of front side resistance bands respectively attach to the glove such that each of the plurality of rear side resistance bands and each of the plurality of front side resistance bands is configured to respectively oppose a bending of a finger of the hand, wherein the finger is selected from the group consisting of a first finger of the hand, a second finger of the hand, a third finger of the hand, a fourth finger of the hand, and a fifth finger of the hand;

wherein the first finger is further defined with a first metacarpal, a first proximal phalange, and a first distal phalange; wherein the second finger is further defined with a second metacarpal, a second proximal phalange, a second intermediate phalange, and a second distal phalange; wherein the third finger is further defined with a third metacarpal, a third proximal phalange, a third intermediate phalange, and a third distal phalange; wherein the fourth finger is further defined with a fourth metacarpal, a fourth proximal phalange, a fourth intermediate phalange, and a fourth distal phalange; wherein the fifth finger is further defined with a fifth metacarpal, a fifth proximal phalange, a fifth intermediate phalange, and a fifth distal phalange;

wherein the gloved is formed from an elastic textile configured to bind the glove to the hand;

wherein each of the plurality of rear side resistance bands is an elastic structure;

wherein a tension of each of the plurality of rear side resistance bands is individually adjustable;

wherein each of the plurality of front side resistance bands is an elastic structure;

wherein a tension of each of the plurality of front side resistance bands is individually adjustable;

wherein the pocket is a storage space formed on the glove;

wherein the squeeze device is sized to fit into the pocket;

wherein the elastomeric structure of the squeeze device is configured to oppose compressive forces when the hand squeezes the squeeze device;

wherein the glove further comprises a first finger stall, a second finger stall, a third finger stall, a fourth finger stall, a fifth finger stall, a trank, and a band pouch;

wherein the first finger stall, the second finger stall, the third finger stall, the fourth finger stall, the fifth finger stall, and the band pouch attach to the trank;

wherein the band pouch is a rouleau formed around an exterior surface of the opening of the glove;

wherein the band pouch forms a channel;

wherein the plurality of rear side resistance bands comprises a first rear side resistance band, a second rear side resistance band, a third rear side resistance band, a fourth rear side resistance band, and a fifth rear side resistance band, each configured to be associated, respectively, with the first finger, the second finger, the third finger, the fourth finger, and the fifth finger;

wherein the plurality of front side resistance bands comprises a first front side resistance band, a second front side resistance band, a third front side resistance band, a fourth front side resistance band, and a fifth front side resistance band, each configured to be associated, respectively, with the first finger, the second finger, the third finger, the fourth finger, and the fifth finger;

wherein each of the plurality of rear side resistance bands and each of the plurality of front side resistance bands is further defined with a proximal end and a distal end;

wherein the first rear side resistance band and the first front side resistance band attach to the glove in order to be configured to align with the first metacarpal, the first proximal phalange, and the first distal phalange;

wherein the second rear side resistance band and the second front side resistance band attach to the glove in order to be configured to align with the second metacarpal, the second proximal phalange, the second intermediate phalange, and the second distal phalange;

wherein the third rear side resistance band and the third front side resistance band attach to the glove in order to be configured to align with the third metacarpal, the third proximal phalange, the third intermediate phalange, and the third distal phalange;

wherein the fourth rear side resistance band and the fourth front side resistance band attach to the glove in order to be configured to align with the fourth metacarpal, the fourth proximal phalange, the fourth intermediate phalange, and the fourth distal phalange;

wherein the fifth rear side resistance band and the fifth front side resistance band attach to the glove in order to be configured to align with the fifth metacarpal, the fifth proximal phalange, the fifth intermediate phalange, and the fifth distal phalange;

wherein the first rear side resistance band further comprises a first rear side band stay, a second rear side band stay, a third rear side band stay, and a fourth rear side band stay;

wherein the first rear side band stay is a cord lock;

wherein the first rear side band stay attaches the proximal end of the first rear side resistance band to the glove;

wherein the first rear side band stay controls the tension of the first rear side resistance band;

wherein the second rear side band stay is a tape that attaches the first rear side resistance band to the glove;

wherein the third rear side band stay is a tape that attaches the first rear side resistance band to the glove;

wherein the fourth rear side band stay is a sewn seam;

wherein the fourth rear side band stay attaches the distal end of the first rear side resistance band to the glove;

wherein the first front side resistance band further comprises a first front side band stay, a second front side band stay, a third front side band stay, and a fourth front side band stay;

wherein the first front side band stay is a cord lock;

wherein the first front side band stay attaches the proximal end of the first front side resistance band to the glove;

wherein the first front side band stay controls the tension of the first front side resistance band;

wherein the second front side band stay is a tape that attaches the first front side resistance band to the glove;

wherein the third front side band stay is a tape that attaches the first front side resistance band to the glove;

wherein the fourth front side band stay is a sewn seam; and wherein the fourth front side band stay attaches the distal end of the first front side resistance band to the glove.

2. The therapeutic device according to claim 1 wherein the second rear side resistance band further comprises a fifth rear side band stay, a sixth rear side band stay, a seventh rear side band stay, an eighth rear side band stay, and a ninth rear side band stay;

wherein the fifth rear side band stay is a cord lock;

wherein the fifth rear side band stay attaches the proximal end of the second rear side resistance band to the glove;

wherein the fifth rear side band stay controls the tension of the second rear side resistance band;

wherein the sixth rear side band stay is a tape that attaches the second rear side resistance band to the glove;

wherein the seventh rear side band stay is a tape that attaches the second rear side resistance band to the glove;

wherein the eighth rear side band stay is a tape that attaches the second rear side resistance band to the glove;

wherein the ninth rear side band stay is a sewn seam;

wherein the ninth rear side band stay attaches the distal end of the second rear side resistance band to the glove;

wherein the second front side resistance band further comprises a fifth front side band stay, a sixth front side band stay, a seventh front side band stay, an eighth front side band stay, and a ninth front side band stay;

wherein the fifth front side band stay is a cord lock;

wherein the fifth front side band stay attaches the proximal end of the second front side resistance band to the glove;

wherein the fifth front side band stay controls the tension of the second front side resistance band;

wherein the sixth front side band stay is a tape that attaches the second front side resistance band to the glove;

wherein the seventh front side band stay is a tape that attaches the second front side resistance band to the glove;

wherein the eighth front side band stay is a tape that attaches the second front side resistance band to the glove;

wherein the ninth front side band stay is a sewn seam;

wherein the ninth front side band stay attaches the distal end of the second front side resistance band to the glove.

3. The therapeutic device according to claim 2 wherein the third rear side resistance band further comprises a tenth rear side band stay, an eleventh rear side band stay, a twelfth rear side band stay, a thirteenth rear side band stay, and a fourteenth rear side band stay;

wherein the tenth rear side band stay is a cord lock;

wherein the tenth rear side band stay attaches the proximal end of the third rear side resistance band to the glove;

wherein the tenth rear side band stay controls the tension of the third rear side resistance band;

wherein the eleventh rear side band stay is a tape that attaches the third rear side resistance band to the glove;

wherein the twelfth rear side band stay is a tape that attaches the third rear side resistance band to the glove;

wherein the thirteenth rear side band stay is a tape that attaches the third rear side resistance band to the glove;

wherein the fourteenth rear side band stay is a sewn seam;

wherein the fourteenth rear side band stay attaches the distal end of the third rear side resistance band to the glove;

wherein the third front side resistance band further comprises a tenth front side band stay, an eleventh front side band stay, a twelfth front side band stay, a thirteenth front side band stay, and a fourteenth front side band stay;

wherein the tenth front side band stay is a cord lock;

wherein the tenth front side band stay attaches the proximal end of the third front side resistance band to the glove;

wherein the tenth front side band stay controls the tension of the third front side resistance band;

wherein the eleventh front side band stay is a tape that attaches the third front side resistance band to the glove;

wherein the twelfth front side band stay is a tape that attaches the third front side resistance band to the glove;

wherein the thirteenth front side band stay is a tape that attaches the third front side resistance band to the glove;

wherein the fourteenth front side band stay is a sewn seam;

wherein the fourteenth front side band stay attaches the distal end of the third front side resistance band to the glove.

4. The therapeutic device according to claim 3 wherein the fourth rear side resistance band further comprises a fifteenth rear side band stay, a sixteenth rear side band stay, a seventeenth rear side band stay, an eighteenth rear side band stay, and a nineteenth rear side band stay;

wherein the fifteenth rear side band stay is a cord lock;

wherein the fifteenth rear side band stay attaches the proximal end of the fourth rear side resistance band to the glove;

wherein the fifteenth rear side band stay controls the tension of the fourth rear side resistance band;

wherein the sixteenth rear side band stay is a tape that attaches the fourth rear side resistance band to the glove;

wherein the seventeenth rear side band stay is a tape that attaches the fourth rear side resistance band to the glove;

wherein the eighteenth rear side band stay is a tape that attaches the fourth rear side resistance band to the glove;

wherein the nineteenth rear side band stay is a sewn seam;

wherein the nineteenth rear side band stay attaches the distal end of the fourth rear side resistance band to the glove;

wherein the fourth front side resistance band further comprises a fifteenth front side band stay, a sixteenth front side band stay, a seventeenth front side band stay, an eighteenth front side band stay, and a nineteenth front side band stay;

wherein the fifteenth front side band stay is a cord lock;

wherein the fifteenth front side band stay attaches the proximal end of the fourth front side resistance band to the glove;

wherein the fifteenth front side band stay controls the tension of the fourth front side resistance band;

wherein the sixteenth front side band stay is a tape that attaches the fourth front side resistance band to the glove;

wherein the seventeenth front side band stay is a tape that attaches the fourth front side resistance band to the glove;

wherein the eighteenth front side band stay is a tape that attaches the fourth front side resistance band to the glove;

wherein the nineteenth front side band stay is a sewn seam;

wherein the nineteenth front side band stay attaches the distal end of the fourth front side resistance band to the glove.

5. The therapeutic device according to claim 4 wherein the fifth rear side resistance band further comprises a twentieth rear side band stay, a twenty-first rear side band stay, a twenty-second rear side band stay, a twenty-third rear side band stay, and a twenty-fourth rear side band stay;

wherein the twentieth rear side band stay is a cord lock;

wherein the twentieth rear side band stay attaches the proximal end of the fifth rear side resistance band to the glove;

wherein the twentieth rear side band stay controls the tension of the fifth rear side resistance band;

wherein the twenty-first rear side band stay is a tape that attaches the fifth rear side resistance band to the glove;

wherein the twenty-second rear side band stay is a tape that attaches the fifth rear side resistance band to the glove;

wherein the twenty-third rear side band stay is a tape that attaches the fifth rear side resistance band to the glove;

wherein the twenty-fourth rear side band stay is a sewn seam;

wherein the twenty-fourth rear side band stay attaches the distal end of the fifth rear side resistance band to the glove;

wherein the fifth front side resistance band further comprises a twentieth front side band stay, a twenty-first front side band stay, a twenty-second front side band stay, a twenty-third front side band stay, and a twenty-fourth front side band stay;

wherein the twentieth front side band stay is a cord lock;

wherein the twentieth front side band stay attaches the proximal end of the fifth front side resistance band to the glove;

wherein the twentieth front side band stay controls the tension of the fifth front side resistance band;

wherein the twenty-first front side band stay is a tape that attaches the fifth front side resistance band to the glove;

wherein the twenty-second front side band stay is a tape that attaches the fifth front side resistance band to the glove;

wherein the twenty-third front side band stay is a tape that attaches the fifth front side resistance band to the glove;

wherein the twenty-fourth front side band stay is a sewn seam;

wherein the twenty-fourth front side band stay attaches the distal end of the fifth front side resistance band to the glove.

6. The therapeutic device according to claim 5 wherein the pocket comprises a sheeting and a plurality of pocket seams;

wherein the sheeting attaches to the trank of the glove and is configured to lie over the palm of the hand;

wherein each of the plurality of pocket seams is a seam that attaches the sheeting to the trank of the glove.

7. The therapeutic device according to claim 6 wherein the first rear side band stay attaches the proximal end of the first rear side resistance band to the rear side of the glove at a location configured to be identified by a joint that joins a proximal end of the first metacarpal to a wrist of the user;

wherein the fourth rear side band stay attaches the distal end of the first rear side resistance band to the rear side of the glove at a location configured to be identified as a distal end of the first distal phalange;

wherein the second rear side band stay attaches the first rear side resistance band to the rear side of the glove at a location configured to be identified as an interphalangeal joint between the first metacarpal and the first proximal phalange;

wherein the third rear side band stay attaches the first rear side resistance band to the rear side of the glove at a location configured to be identified as an interphalangeal joint between the first proximal phalange and the first distal phalange;

wherein the fifth rear side band stay attaches the proximal end of the second rear side resistance band to the rear side of the glove at a location configured to be identified by a joint that joins a proximal end of the second metacarpal to the wrist;

wherein the ninth rear side band stay attaches the distal end of the second rear side resistance band to the rear side of the glove at a location configured to be identified as a distal end of the second distal phalange;

wherein the sixth rear side band stay attaches the second rear side resistance band to the rear side of the glove at a location configured to be identified as an interphalangeal joint between the second metacarpal and the second proximal phalange;

wherein the seventh rear side band stay attaches the second rear side resistance band to the rear side of the glove at a location configured to be identified as an interphalangeal joint between the second proximal phalange and the second intermediate phalange;

wherein the eighth rear side band stay attaches the second rear side resistance band to the rear side of the glove at a location configured to be identified as an interphalangeal joint between the second intermediate phalange and the second distal phalange;

wherein the tenth rear side band stay attaches the proximal end of the third rear side resistance band to the rear side of the glove at a location configured to be identified by a joint that joins a proximal end of the third metacarpal to the wrist;

wherein the fourteenth rear side band stay attaches the distal end of the third rear side resistance band to the rear side of the glove at a location configured to be identified as a distal end of the third distal phalange;

wherein the eleventh rear side band stay attaches the third rear side resistance band to the rear side of the glove at a location configured to be identified as an interphalangeal joint between the third metacarpal and the third proximal phalange;

wherein the twelfth rear side band stay attaches the third rear side resistance band to the rear side of the glove at a location configured to be identified as an interphalangeal joint between the third proximal phalange and the third intermediate phalange;

wherein the thirteenth rear side band stay attaches the third rear side resistance band to the rear side of the glove at a location configured to be identified as an interphalangeal joint between the third intermediate phalange and the third distal phalange;

wherein the fifteenth rear side band stay attaches the proximal end of the fourth rear side resistance band to the rear side of the glove at a location configured to be identified by a joint that joins a proximal end of the fourth metacarpal to the wrist;

wherein the nineteenth rear side band stay attaches the distal end of the fourth rear side resistance band to the rear side of the glove at a location configured to be identified as a distal end of the fourth distal phalange;

wherein the sixteenth rear side band stay attaches the fourth rear side resistance band to the rear side of the glove at a location configured to be identified as an interphalangeal joint between the fourth metacarpal and the fourth proximal phalange;

wherein the seventeenth rear side band stay attaches the fourth rear side resistance band to the rear side of the glove at a location configured to be identified as an interphalangeal joint between the fourth proximal phalange and the fourth intermediate phalange;

wherein the eighteenth rear side band stay attaches the fourth rear side resistance band to the rear side of the glove at a location configured to be identified as an interphalangeal joint between the fourth intermediate phalange and the fourth distal phalange;

wherein the twentieth rear side band stay attaches the proximal end of the fifth rear side resistance band to the rear side of the glove at a location configured to be identified by a joint that joins a proximal end of the fifth metacarpal to the wrist;

wherein the twenty-fourth rear side band stay attaches the distal end of the fifth rear side resistance band to the rear side of the glove at a location configured to be identified as distal end of the fifth distal phalange;

wherein the twenty-first rear side band stay attaches the fifth rear side resistance band to the rear side of the glove at a location configured to be identified as an interphalangeal joint between the fifth metacarpal and the fifth proximal phalange;

wherein the twenty-second rear side band stay attaches the fifth rear side resistance band to the rear side of the glove at a location configured to be identified as an interphalangeal joint between the fifth proximal phalange and the fifth intermediate phalange;

wherein the twenty-third rear side band stay attaches the fifth rear side resistance band to the rear side of the glove at a location configured to be identified as an interphalangeal joint between the fifth intermediate phalange and the fifth distal phalange;

wherein the first front side band stay attaches the proximal end of the first front side resistance band to the front side of the glove at the location configured to be identified by the joint that joins the proximal end of the first metacarpal to the wrist;

wherein the fourth front side band stay attaches the distal end of the first front side resistance band to the front side of the glove at the location configured to be identified as the distal end of the first distal phalange;

wherein the second front side band stay attaches the first front side resistance band to the front side of the glove at the location configured to be identified as the interphalangeal joint between the first metacarpal and the first proximal phalange;

wherein the third front side band stay attaches the first front side resistance band to the front side of the glove at the location configured to be identified as the interphalangeal joint between the first proximal phalange and the first distal phalange;

wherein the fifth front side band stay attaches the proximal end of the second front side resistance band to the front side of the glove at the location configured to be identified by the joint that joins the proximal end of the second metacarpal to the wrist;

wherein the ninth front side band stay attaches the distal end of the second front side resistance band to the front side of the glove at the location configured to be identified as the distal end of the second distal phalange;

wherein the sixth front side band stay attaches the second front side resistance band to the front side of the glove at the location configured to be identified as the interphalangeal joint between the second metacarpal and the second proximal phalange;

wherein the seventh front side band stay attaches the second front side resistance band to the front side of the glove at the location configured to be identified as the interphalangeal joint between the second proximal phalange and the second intermediate phalange;

wherein the eighth front side band stay attaches the second front side resistance band to the front side of the glove at the location configured to be identified as the interphalangeal joint between the second intermediate phalange and the second distal phalange;

wherein the tenth front side band stay attaches the proximal end of the third front side resistance band to the front side of the glove at the location configured to be identified by the joint that joins the proximal end of the third metacarpal to the wrist;

wherein the fourteenth front side band stay attaches the distal end of the third front side resistance band to the front side of the glove at the location configured to be identified as the distal end of the third distal phalange;

wherein the eleventh front side band stay attaches the third front side resistance band to the front side of the glove at the location configured to be identified as the interphalangeal joint between the third metacarpal and the third proximal phalange;

wherein the twelfth front side band stay attaches the third front side resistance band to the front side of the glove at the location configured to be identified as the interphalangeal joint between the third proximal phalange and the third intermediate phalange;

wherein the thirteenth front side band stay attaches the third front side resistance band to the front side of the glove at the location configured to be identified as the interphalangeal joint between the third intermediate phalange and the third distal phalange;

wherein the fifteenth front side band stay attaches the proximal end of the fourth front side resistance band to the front side of the glove at the location configured to be identified by the joint that joins the proximal end of the fourth metacarpal to the wrist;

wherein the nineteenth front side band stay attaches the distal end of the fourth front side resistance band to the front side of the glove at the location configured to be identified as the distal end of the fourth distal phalange;

wherein the sixteenth front side band stay attaches the fourth front side resistance band to the front side of the glove at the location configured to be identified as the interphalangeal joint between the fourth metacarpal and the fourth proximal phalange;

wherein the seventeenth front side band stay attaches the fourth front side resistance band to the front side of the glove at the location configured to be identified as the interphalangeal joint between the fourth proximal phalange and the fourth intermediate phalange;

wherein the eighteenth front side band stay attaches the fourth front side resistance band to the front side of the glove at the location configured to be identified as the interphalangeal joint between the fourth intermediate phalange and the fourth distal phalange;

wherein the twentieth front side band stay attaches the proximal end of the fifth front side resistance band to the front side of the glove at the location configured to be identified by the joint that joins the proximal end of the fifth metacarpal to the wrist;

wherein the twenty-fourth front side band stay attaches the distal end of the fifth front side resistance band to the front side of the glove at the location configured to be identified as the distal end of the fifth distal phalange;

wherein the twenty-first front side band stay attaches the fifth front side resistance band to the front side of the glove at the location configured to be identified as the interphalangeal joint between the fifth metacarpal and the fifth proximal phalange;

wherein the twenty-second front side band stay attaches the fifth front side resistance band to the front side of the glove at the location configured to be identified as the interphalangeal joint between the fifth proximal phalange and the fifth intermediate phalange;

wherein the twenty-third front side band stay attaches the fifth front side resistance band to the front side of the glove at the location configured to be identified as the interphalangeal joint between the fifth intermediate phalange and the fifth distal phalange.

8. The therapeutic device according to claim 7 wherein the plurality of pocket seams attaches the sheeting to a front side of the trank of the glove such that the squeeze device inserts into the pocket and between the sheeting and the trank.

9. The therapeutic device according to claim 8 wherein each of the plurality of rear side resistance bands is selected from the group consisting of an elastic cord or an elastic webbing;

wherein each of the plurality of front side resistance bands is selected from the group consisting of an elastic cord or an elastic webbing.

10. The therapeutic device according to claim 9 wherein the squeeze device is selected from the group consisting of one or more elastomeric spheres and an elastomeric cylinder.

11. The therapeutic device according to claim 10 wherein the first finger stall attaches to the trank and is configured such that the first finger inserts into the first finger stall when the hand inserts into the opening of the glove;

wherein the second finger stall attaches to the trank and is configured such that the second finger inserts into the second finger stall when the hand inserts into the opening of the glove;

wherein the third finger stall attaches to the trank and is configured such that the third finger inserts into the third finger stall when the hand inserts into the opening of the glove;

wherein the fourth finger stall attaches to the trank and is configured such that the fourth finger inserts into the fourth finger stall when the hand inserts into the opening of the glove;

wherein the fifth finger stall attaches to the trank and is configured such that the fifth finger inserts into the fifth finger stall when the hand inserts into the opening of the glove.

* * * * *